US007645068B2

(12) United States Patent
Mahler et al.

(10) Patent No.: US 7,645,068 B2
(45) Date of Patent: Jan. 12, 2010

(54) WATCH COMPRISING A MECHANISM FOR DRIVING A DEVICE THAT DISPLAYS A TIME-DEPENDENT VALUE

(75) Inventors: Olivier Mahler, Boecourt (CH); Alphonse Bron, Bassecourt (CH)

(73) Assignee: Compagnie des Montres Longines, Francillon S.A., St-Imier (CH)

( * ) Notice: Subject to any disclaimer, the term of this patent is extended or adjusted under 35 U.S.C. 154(b) by 210 days.

(21) Appl. No.: 12/018,880

(22) Filed: Jan. 24, 2008

(65) Prior Publication Data

US 2008/0181060 A1 Jul. 31, 2008

(30) Foreign Application Priority Data

Jan. 30, 2007 (EP) ..... 07001959

(51) Int. Cl.
*G04B 18/00* (2006.01)
*G04B 27/00* (2006.01)
*G04B 27/04* (2006.01)

(52) U.S. Cl. ..... 368/185; 368/190; 368/192; 368/195

(58) Field of Classification Search ..... 368/185, 368/190–195
See application file for complete search history.

(56) References Cited

U.S. PATENT DOCUMENTS 2,976,672 A * 3/1961 Ducommun ..... 368/37
3,421,311 A * 1/1969 Bennett et al. ..... 368/185
3,775,965 A * 12/1973 Besson et al. ..... 368/35
3,992,868 A 11/1976 Tamaru et al.
4,234,943 A * 11/1980 Teramoto et al. ..... 368/35
4,809,250 A * 2/1989 Meier ..... 368/208
4,845,693 A * 7/1989 Kubota ..... 368/185
5,742,565 A * 4/1998 Cuinet et al. ..... 368/190
6,295,249 B1 * 9/2001 Takahashi et al. ..... 368/35
7,023,762 B1 * 4/2006 Burkhardt et al. ..... 368/35

FOREIGN PATENT DOCUMENTS

EP 0 218 926 4/1987
EP 0 871 093 A1 10/1998
FR 1.426.305 12/1966
FR 2.080.602 11/1971

OTHER PUBLICATIONS

European Search Report issued in corresponding application No. EP 07 00 1959, completed Sep. 7, 2007.

* cited by examiner

*Primary Examiner*—Renee S Luebke
*Assistant Examiner*—Thanh S Phan
(74) *Attorney, Agent, or Firm*—Griffin & Szipl, P.C.

(57) ABSTRACT

Watch comprising a mechanism (50) for driving a device (1) that displays a time-dependent value, this drive mechanism (50) itself being driven by the movement of the watch, this watch also having at least one first correction element (42) acting on the display device (50) via a clockwork mechanism (2) of the drive mechanism (50), and at least one second correction element (48) acting directly on the device (1) that displays the time-dependent value, the watch being characterised in that the drive mechanism (50) is arranged so as to drive the device (1) that displays a time-dependent value in both directions when the first correction element (42) is operated, and so as to be overridden when the second correction element (48) is operated, acting directly on the device (1) that displays a time-dependent value.

14 Claims, 3 Drawing Sheets

Prior Art

WATCH COMPRISING A MECHANISM FOR DRIVING A DEVICE THAT DISPLAYS A TIME-DEPENDENT VALUE

This application claims priority from European Patent Application No. 07001959.1 filed Jan. 30, 2007, the entire disclosure of which is incorporated herein by reference.

FIELD OF THE INVENTION

The present invention concerns a correction mechanism for a device, in a watch, that displays a time-dependent value. More precisely, the present invention concerns a mechanism of this type for the two-way correction of a device that displays a time-dependent value such as a calendar date mechanism.

BACKGROUND OF THE INVENTION

A calendar date display mechanism is shown in FIG. 1 accompanying the present patent application. Indicated as a whole by the general reference numeral 1, this calendar date display mechanism is driven by an intermediate wheel 2 which is fixed to an hour wheel (not shown). In other words, the intermediate wheel 2 turns in a clockwise direction and completes a full turn in twelve hours. This intermediate wheel 2 engages with a calendar date drive wheel 4 which turns in an anti-clockwise direction at a rate of one turn in twenty-four hours. This calendar date drive wheel 4 has a finger 6 with which it drives, at a rate of one tooth pitch per day, a calendar date wheel 8 which is indexed by a pawl 10 and carries a cam 12. At one point of its profile, the cam has a steep flank 14 which marks the passage between the calendar date of the last day of a given month and the calendar date of the first day of the following month, in other words between the calendar date "31" and the calendar date "1".

The calendar date display mechanism 1 is completed by a control lever 16 having at one of its ends an arm 18 whereby it rests against the cam 12 during a period of normal operation, and having at its other end a rack 20 whereby it engages with a calendar date display wheel 22 which carries the calendar date indicator (not shown). The control lever 16 is pivoted at 24 whereas a second lever 26 called the return lever is pivoted at 28. This return lever 26 has a structure similar to that of the control lever 16, in particular comprising a rack 30 whereby it engages with the calendar date display wheel 22. As shown in FIG. 1, the return lever 26 is constrained by a spring element 32 which tends to turn it in a clockwise direction. In turn, the return lever 26 tends to turn the calendar date display wheel 22 in an anti-clockwise direction, which tends to turn the control lever 16 in a clockwise direction and to keep its arm 18 resting against the profile of the cam 12.

At the end opposite to the one that carries the rack 30, the return lever 26 has a feeler 36 which cooperates with a circular cam 38, centred on the centre of the movement, on the inner profile of which the feeler 36 of the return lever 26 comes to rest. Note that in the state in which the calendar date display mechanism is shown in FIG. 1, the feeler 36 of the return lever 26 is located at a step 40 that the circular cam 38 has on its inner profile.

FIG. 1 shows that the arm 18 of the control lever 16 is at the bottom of the steep flank 14 that the cam 12 has on its profile. This means that the calendar date indicator mechanism, to which in particular the calendar date wheel 6 and its associated cam 12 belong, has just passed from the last calendar date "31" of a given month to the first calendar date "1" of the following month. Let us now suppose that, starting from this situation, the indication of the calendar date must be corrected. If, during this correction, the calendar date wheel 8 turns in a clockwise direction, no particular problem is observed. The arm 18 of the control lever 16 will follow the profile of the cam 12 and drive, by its rack 20, the calendar date display wheel 22, which will have the effect of increasing step by step the indication of calendar date. By contrast, it is a different matter if the calendar date correction operation causes the calendar date wheel 8, and thus the cam 12, to rotate in the opposite direction. In fact, in this case, the arm 18 of the control lever 16 will brace against the steep flank 14 of the profile of said cam 12 and the mechanism will be blocked. This is why an arrangement must be made so that, when a backward correction is made to the indication of the calendar date, the arm 18 of the control lever 16 is moved aside from the path of the cam 12. The circular cam 38, connected to a winding stem 42, is provided to resolve this problem.

In fact, the winding stem 42 is connected cinematically to the circular cam 38 via an element 44 which makes it possible to transform a linear movement of said winding stem 42 into a pivoting movement of said circular cam 38. Supposing that the winding stem 42 is pulled out in order to move it from its neutral winding position to a first pulled position, this causes the annular cam 38 to pivot in an anti-clockwise direction in a way that will not be described in further detail here. Nevertheless, it will be understood that the pivoting of the annular cam 38 in an anti-clockwise direction allows the arm 18 of the control lever 16 to be distanced from the path of the cam 12. Indeed, under the pivoting effect of said annular cam 38, the feeler 36 of the return lever 26 moves up along the flank 46 of the step 40 and slides along the inner perimeter of the annular cam 38. In doing this, the return lever 26 pivots in an anti-clockwise direction and causes, via the calendar date display wheel 22, the pivoting of the control lever 16, also in an anti-clockwise direction, which has the effect of distancing the arm 18 of this control lever 16 from the path of the cam 12.

Moving the winding stem 42 from its first pulled position to a second pulled position causes an additional pivoting of the annular cam 38. This pivoting, however, has no effect on the return lever 26 since its feeler 36 has climbed the flank 46 of the step 40 and slides on the inner perimeter of the annular cam 38. The arm 18 of the control lever 16 therefore remains beyond the path of the cam 12.

Let us now discuss the reasons why it is necessary to move aside the arm 18 of the control lever 16 from the path of the cam 12. Supposing that the winding stem 42 is brought into its first pulled position, it can be turned forwards or backwards. Now, when the winding stem 42 is turned, the hour wheel (not shown), and therefore also the intermediate wheel 2, are turned. If the intermediate wheel 2 turns in a clockwise direction, in other words the direction in which it turns during normal operation, the cam 12 turns in an anti-clockwise direction and the arm 18 of the control lever 16 slides without any problem along the profile of said cam 12. By contrast, if the intermediate wheel 2 turns in an anti-clockwise direction, the cam 12 will turn in a clockwise direction and the arm 18 of the control arm 16 will brace against the steep flank 14 of said cam 12 and jam. This is why, in this case, the arm 18 of the control lever 16 must be moved aside from the path of the cam 12.

The calendar date display mechanism 1 described above is particularly well suited for use in a time zone type watch. In the case of a time zone watch of this type, the winding stem 42 has three set positions, namely a neutral position in which it allows the clockwork to be wound, a first pulled position which allows the time zone indication to be corrected (it may be a jumping indicator which goes forwards or backwards a whole step of one hour without the minutes display being affected) and a second pulled position which allows the watch time to be set. It must therefore be possible for the calendar date drive wheel 4 to drive, via its finger 6, the calendar date wheel 8 in both a clockwise and an anti-clockwise direction. This is done without any difficulty when the correction is made by means of the winding stem 42. Indeed, in this case, the winding stem 42 drives the hours wheel and thus the intermediate wheel 2 which in its turn drives the calendar date drive wheel 4 and its finger 6. By contrast, a problem may arise when one wishes to correct the indication of a calendar date by means of the rapid corrector 48 shown in FIG. 1. Indeed, by repeatedly pressing the rapid corrector 48, the indication of the calendar date can be increased by steps of one unit, making this indication pass for example from "1" to "2", then from "2" to "3" and so forth. It must be understood that, in this scenario, the hour wheel, the intermediate wheel 2 and therefore the calendar date drive wheel 4 are substantially stationary. Consequently, if a rapid adjustment of the indication of the calendar date is desired while the finger 6 is engaged in the toothing of the calendar date wheel 8 (for a duration of approximately 1 to 1 and a half hours around midnight when the drive of the calendar date wheel 8 by the calendar date drive wheel 4 is of the trailing type), the mechanism will be jammed. There is thus a need for a drive system, for example, in a calendar date display mechanism, and more generally for any type of device that displays a time-dependent value, which system is capable of driving such a mechanism or device both in a clockwise and in an anti-clockwise direction under normal operating conditions and is capable of being moved aside during the rapid correction phase.

In order to meet this need, different solutions are already available. For example, a rapid adjustment mechanism for a calendar watch is known through Patent FR 2.080.602 in the name of the Hamilton Watch Company. As shown in FIGS. 1 and 2 of the corresponding description on page 6, line 35 to page 7, line 38, the rapid adjustment action of the calendar date ring is performed by means of a ratchet articulated on a first pivot and a ratchet spring articulated on a second pivot. A shoulder of the ratchet is normally abutted against the part where the spring is fitted to the second pivot. During the rapid correction phase of the calendar date ring, the ratchet pivots in an anti-clockwise direction around the first pivot within the peripheral limits of the teeth of the calendar date ring. Each rotation of the ratchet advances the calendar date ring one by one tooth. When the watch display is corrected in the opposite direction, the ratchet is driven in a clockwise direction, which makes it pivot about the first pivot against the action of the spring when it encounters a tooth of the calendar date ring. This pivoting effect makes the ratchet pass onto the teeth of the calendar date ring without driving the latter backwards.

The above-described Hamilton system is a ratchet system which drives the calendar date ring in a clockwise direction only and is moved aside when said ring is corrected in the opposite direction. Said ratchet is not capable of driving the calendar date ring in both a clockwise and anti-clockwise direction during the normal correction phase of the calendar date display.

A rapid reset ratchet calendar date mechanism is also known through Patent FR 1.426.305 in the name of Horlogerie de Savoie. As emerges from FIGS. 1 and 2 and the description from page 1, right-hand column, line 19 to page 2, left-hand column, line 6, the rapid reset mode operates via a ratchet which is driven in an anti-clockwise direction and which, under the action of a spring, is held against a pin. After sufficient rotation, the end of the ratchet abuts against the face of the tooth of the calendar date ring, which forces the ratchet to release itself from the pin, its end jumping over the tooth against the toothing then penetrating into the next gap in this toothing.

The ratchet system briefly described above is capable of driving the calendar date ring in one direction only. In the opposite direction, it is moved aside in the rapid correction phase.

A watch with a calendar date mechanism is also known through U.S. Pat. No. 3,992,868 in the name of the Citizen Watch Co. Ltd. As emerges from FIG. 4 and the corresponding description in column 2, lines 3 to 53, a resilient lever comprising a drive ratchet and two resilient arms is mounted in a pivoting manner on the calendar date wheel and held in place by a rivet. Under normal conditions, the resilient spring is positioned so that the arms surround a hub of the calendar date wheel. When the ratchet is subjected to a drive force in a first direction, one of its arms is elastically deformed and, when the force exceeds a set threshold, this arm is further deformed and comes into contact with a switch pin. On the other hand, when the ratchet is forced in a second direction opposite to the first during a rapid rotation of the calendar date plate, the other arm is deformed. The ratchet of the resilient lever acts so as to drive the calendar date plate in rotation, then the ratchet comes into contact with the switch pin due to the deformation of the arm.

Neither does the above-described Citizen system enable the calendar date plate to be driven in both directions.

SUMMARY OF THE INVENTION

In view of the above, the object of the present invention is to provide a new drive system for a device which displays a time-dependent value and which overcomes the drawbacks of the prior art.

To that end, the present invention concerns a watch comprising a mechanism for driving a device that displays a time-dependent value, this drive mechanism being itself driven by the movement of the watch, this watch also having at least one first correction element acting on the display device via a clockwork gear train and the drive mechanism, and at least one second correction element acting directly on the device that displays the time-dependent value, the watch being characterised in that the drive mechanism is arranged so as to drive the device that displays the time-dependent value in both directions when the first correction element is activated, and so as to be moved aside when the second correction element acts directly on the device that displays the time-dependent value.

Thanks to these features, the present invention provides a watch whose mechanism for driving a device that displays a time-dependent value is capable of driving this display device both in a clockwise direction and in the opposite direction when one wishes to perform a correction operation via the clockwork gear train, and which is also capable of being moved aside when one wishes to perform a correction operation on the display device directly. This is particularly advantageous in that, even when the first correction element is engaged in the display device, it is still possible to correct the indication provided by this display device by means of the second correction element. The indication provided by the device that displays a time-dependent value can therefore be corrected at any moment.

According to a complementary feature of the invention, the drive mechanism has a finger whereby it is capable of driving the display device both in a forward and in a backward direction when said device is driven by the first correction element via the clockwork mechanism, this finger being capable of being moved aside when said display device is acted on via the second correction element.

According to another feature of the invention, the drive mechanism has a wheel carrying the finger, this finger being connected to a spring by a first pin about which it can pivot, the pivoting angle of said finger being limited by a second pin to which it is fixed and which is engaged in a hole made in the drive wheel, the spring keeping the finger in a position in which said finger is engaged in the toothing of a driven wheel of the display device in order to drive this wheel in a clockwise or anti-clockwise direction, this spring allowing said finger to free itself from the driven wheel toothing when a correction of the display device is performed by means of the second display element.

According to yet another feature of the invention, the drive mechanism drives the display device in a trailing manner and the second correction element allows said display device to be corrected manually by increasing it in successive steps of one unit.

BRIEF DESCRIPTION OF THE DRAWINGS

Further features and advantages of the present invention will emerge more clearly from the following detailed description of an embodiment of the watch according to the invention, which embodiment is shown, purely by way of example and without imposing any limitations, in the accompanying drawings in which.

DETAILED DESCRIPTION OF THE PREFERRED EMBODIMENT

The present invention proceeds from the general inventive idea which consists in obtaining a mechanism for driving a device which displays a time-dependent value and is capable of driving this display device in both a clockwise and an anti-clockwise direction when it is itself driven by the movement of the watch, and which is also capable of being moved aside when one makes a manual correction of said display device by increasing its indication in successive steps of one unit. Thanks to these arrangements, the present invention allows the indication provided by the display device to be corrected at any time, even when the drive of said display device is of the trailing type.

The present invention will be described in relation to a calendar date display device. It goes without saying that this example is given purely by way of example, and that the present invention applies to any type of device that displays a time-dependent value such as the day of the week, the indication of the month of the year or even the indication of the phases of the moon.

Figure 1:
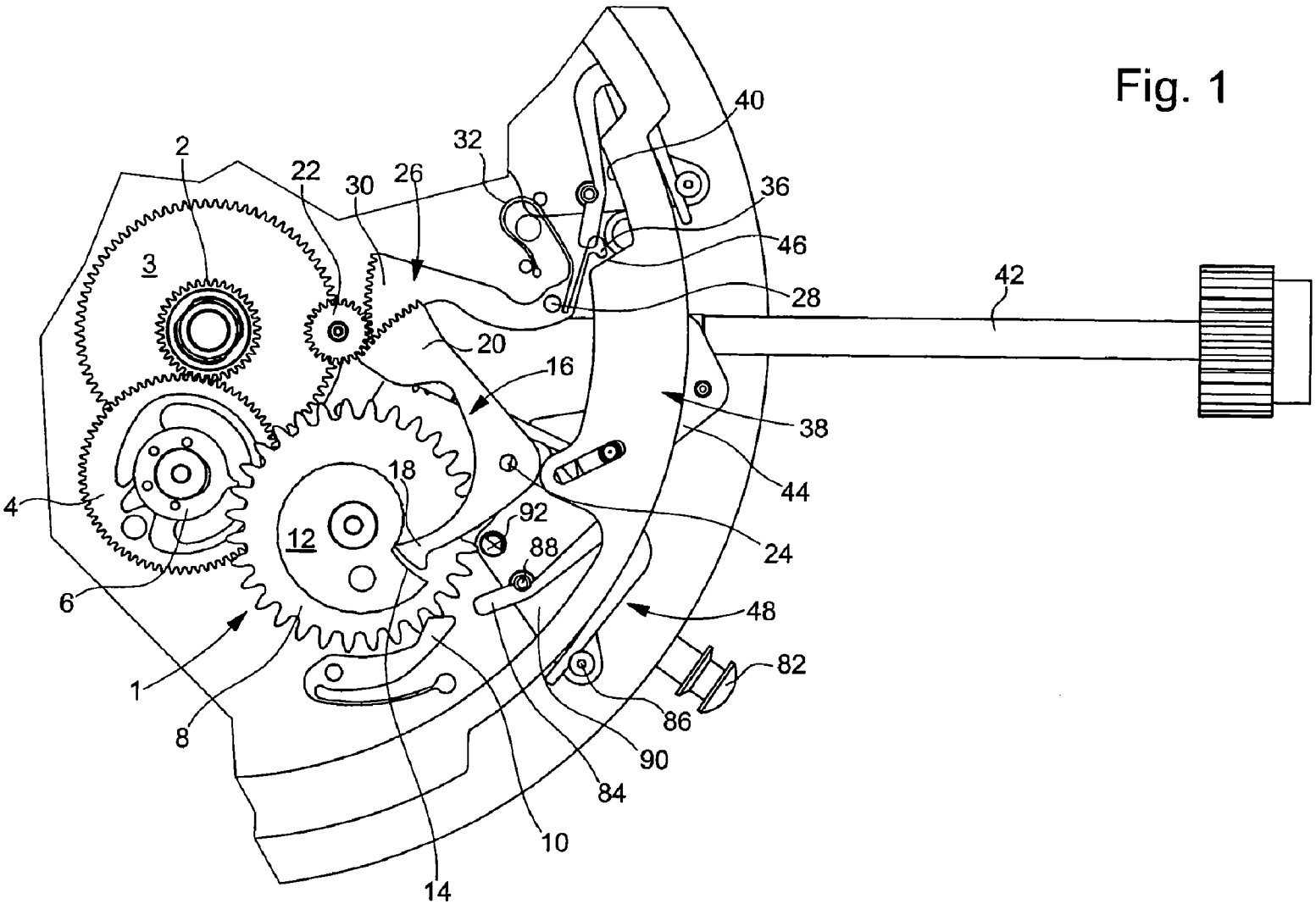
FIG. 1, mentioned previously, is a plan view of part of a watch movement having a calendar date display device driven by a drive mechanism according to the prior art.
Figure 2:
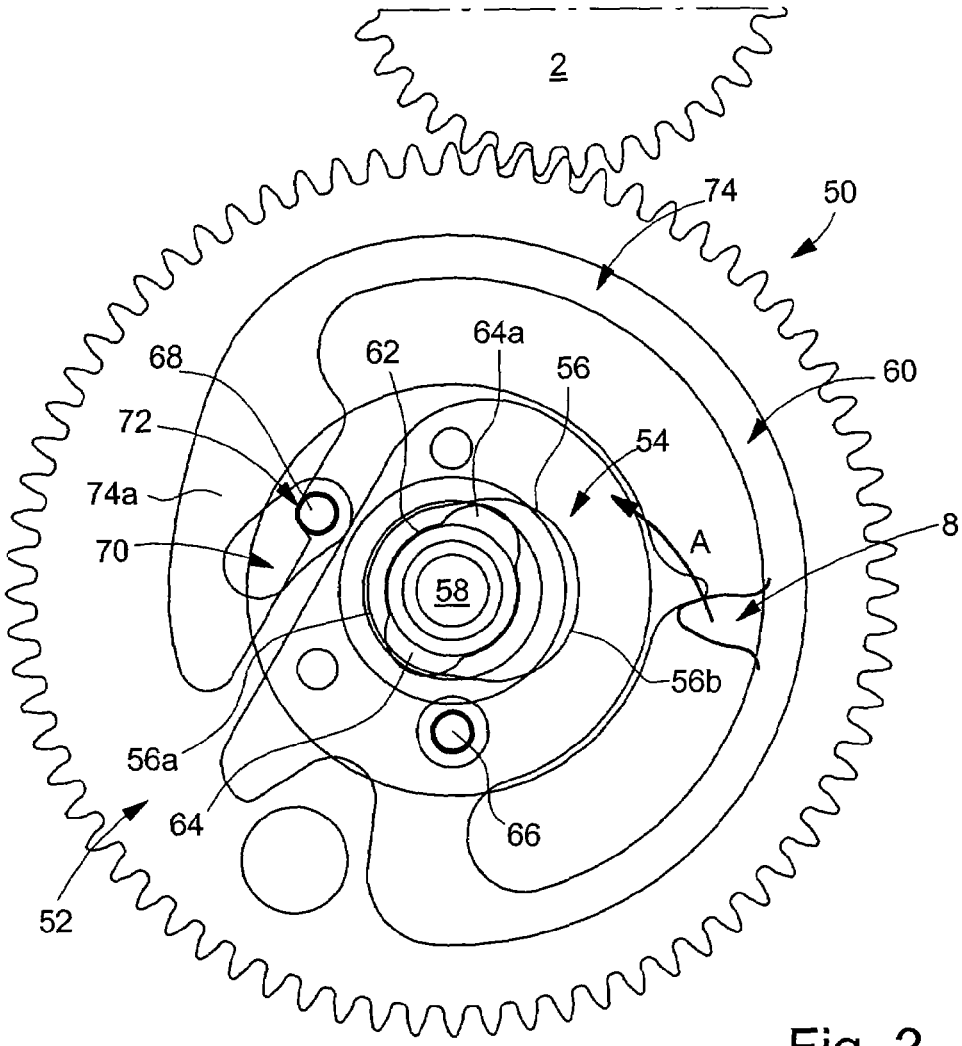
FIG. 2 is a plan view of a drive mechanism of a device that displays a time-dependent value according to the invention.
Figure 3:
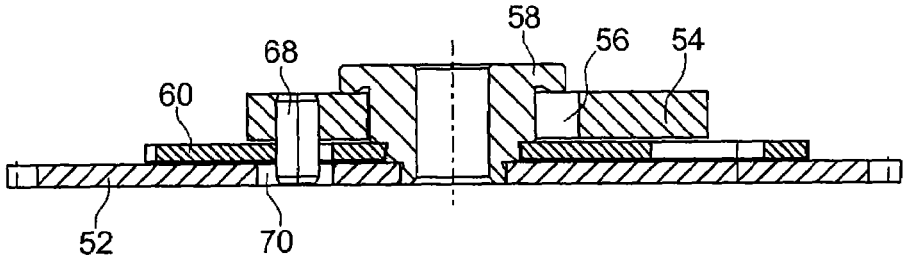
FIG. 3 is a cross-section of the drive mechanism shown in FIG. 2.

The drive mechanism according to the invention is shown in plan and cross-sectional views respectively in FIGS. 2 and 3 accompanying the present patent application. Indicated as a whole by the general reference numeral 50, this mechanism comprises a drive wheel 52 which, in a device that displays a time-dependent value (not shown), plays the same role as that played by the calendar date drive wheel 4 in the calendar date mechanism 1 shown in FIG. 1. In other words, this drive wheel 52 is driven by the hour wheel of the watch movement via the intermediate wheel 2, and in its turn drives via a finger 54 the calendar date wheel 8 of the calendar date display device 1.

The finger 54 is carried by the drive wheel 52. For this purpose, the finger 54 has an oblong opening 56 whereby it is engaged on a hub 58 of said drive wheel 52. A spring 60 holds the finger 54 in a position in which this finger 54 is engaged in the toothing of the calendar date wheel 8 in order to drive said wheel in a clockwise or anti-clockwise direction. However, as will be seen in detail below, this spring 60 also allows the finger 54 to free itself from the toothing of the calendar date wheel 8 during a manual correction of the indication of the calendar date by means of the rapid corrector 48. As illustrated in FIGS. 2 and 3, the spring 60 is disposed between the drive wheel 52 and the finger 54. For this purpose, the spring 60 has a circular opening 62 having diametrically opposite ears 64*a* and 64*b* whereby it is engaged in friction on the hub 58 of said drive wheel 52. It will be noted that during normal operation, the spring 60 is stationary in relation to the drive wheel 52. The friction fit of said spring 60 on said drive wheel 52, enabled by the presence of the two ears 64*a* and 64*b*, is provided simply to enable a fine adjustment of the drive mechanism 50 according to the invention as described below.

The finger 54 is connected to the spring 60 by means of a pin 66. This pin 66 is set into the finger 54 but is free to pivot in the opening made in the spring 60 in which it is engaged. This pin 66 constitutes the pivoting point of the finger 54. A second pin 68 is provided, also set into the finger 54 and engaged in an oblong opening 70 made in the drive wheel 52 in which this pin 68 is free to move. As shown in FIG. 2, the pin 68 is positioned in a recess 72 provided near the free end 74*a* of a substantially semi-circular resilient arm 74 of the spring 60.

During normal operation, as shown in FIG. 2, of the drive mechanism 50 according to the present invention, the finger 54 must be rigid. This means that the finger 54 must be able to drive the calendar date wheel 8 in both a clockwise and an anti-clockwise direction without setting itself in the manner of an instantaneous or semi-instantaneous spring mechanism. Note also that normal operation means the periods when the intermediate wheel 2 is driving the drive wheel 52, either because this intermediate wheel 2 is being driven by the watch movement in a clockwise direction, or because this intermediate wheel 2 is being driven in a clockwise or anti-clockwise direction by the action of the winding stem 42. In other words, during normal operation, the intermediate wheel 2 turns and drives the drive wheel 52 which itself drives the calendar date wheel 8. This is made possible by the fact that the spring 60 exerts on the finger 54 a retaining torque sufficient to enable said finger 54 to overcome the slight torque exerted by the calendar date wheel 8. Similarly, the finger 54 is abutted by the semi-circular part 56*a* of its oblong opening 56 against the hub 58 of the drive wheel 52.

The situation is completely different during the rapid correction phase. During such a phase, the watch user wishes to be able to increase by successive steps of one unit the indication provided by the calendar date display device, to which in particular the calendar date wheel 8 belongs, by means of the rapid corrector 48. In this case, the intermediate wheel 2 may be regarded as being substantially stationary in that, driven by the hour wheel, it performs a complete turn in twelve hours. Consequently, during a rapid correction phase, the drive wheel 52 is stationary. If, at the moment when the user chooses to correct the indication of the calendar date with the aid of the rapid corrector 48, the finger 54 is not engaged in the toothing of the calendar date wheel 8, there is no particular problem. If, on the other hand, this moment coincides with the period when the finger 54 is engaged in the toothing of the calendar date wheel 8 (usually around midnight), jamming occurs. In fact, the intermediate wheel 2, and therefore the drive wheel 52 and the finger 54, are stationary and it is not possible to move the calendar date wheel 8 forward.

Figure 4:
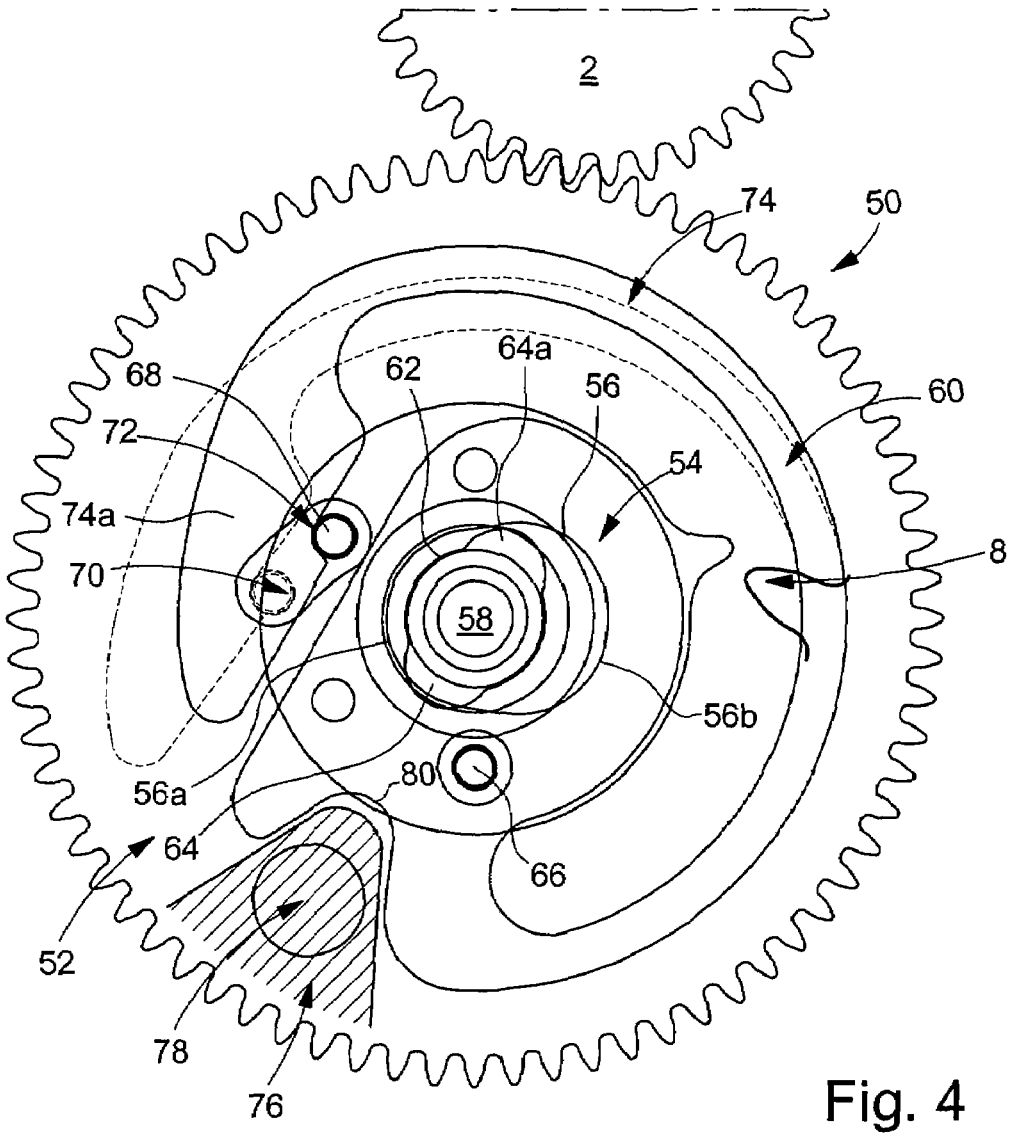
FIG. 4 is a similar view to that of FIG. 2 when a rapid correction is being made.

The present invention allows this problem to be overcome. In fact, on attempting to move the calendar date wheel 8 forward by means of the rapid corrector 48, the latter pushes the finger 54, in the direction shown by Arrow A in FIG. 2. Under the effect of this push, the finger 54, which was applied against the hub 58 by the semi-circular part 56*a* of its oblong opening 56, moves and abuts against said hub 58 via its semi-circular part 56*b* opposite the semi-circular part 56*a* of its oblong opening 56. At the same time, said finger 54 pivots around the pin 66 and moves away from the trajectory of the tooth of the calendar date wheel 8 with which it was engaged, which allows this tooth to go past. While pivoting, the finger 54, by its pin 68, slightly distances the free end 74*a* of the resilient arm 74 from its at-rest position (see position shown by the dotted lines in FIG. 4) by counteracting the resilient return forces of the spring 60. As soon as the tooth of the calendar date wheel 8 has passed the finger 54, the resilient arm 74 returns to its at-rest position and brings back said finger 54, which again pivots about the pin 66 and returns to its initial position. Thus, thanks to the present invention, it is possible to make a rapid correction of the indication of the calendar date at any time and, in particular, during the period of time when the finger 54 is engaged in the toothing of the calendar date wheel 8.

It goes without saying that the present invention is not limited to the embodiment that has just been described and that various simple modifications and variations can be envisaged by a person skilled in the art without departing from the scope of the present invention as defined by the accompanying claims. In particular, it will be noted that, as previously mentioned above, the spring 60 is mounted in an almost permanent way on the hub 58 of the drive wheel 52, only a tool 76 engaged in an opening 78 made in said drive wheel 52 at a recess 80 in the spring 60 allowing said spring 60 to be slightly moved in relation to said hub 58 by a few degrees in a clockwise or anti-clockwise direction to take up any play and synchronize the jump of the calendar date with the jump of the day. Nevertheless, according to a simplified variation of the invention, the spring 60 can be mounted rigidly on the drive wheel 52 if the tolerance between the jump of the calendar date indication and the jump of the day indication is large. Moreover, the rapid correction mechanism 48 is shown in detail in FIG. 1. It in particular comprises a rapid correction pushbutton 82 which acts against the resilient return force exerted by a spring 84 held under tension between a first lug 86 connected to the watch case and a second lug 88 carried by a control lever 90 upon which the pushbutton 82 acts. This control lever 90 is capable of pivoting about the lug 86 and carries a corrector element 92 which penetrates into the teeth of the calendar date wheel 8.

What is claimed is:

1. A watch comprising a mechanism for driving a device that displays a time-dependent value, this drive mechanism itself being driven by a movement of the watch, this driving mechanism having a finger by which it is capable of driving the display device forwards and backwards when it is itself driven by a first correction element acting on said display device via a clockwork gear train and said drive mechanism, the finger being capable of being moved aside when the display device is acted on directly via a second correction element, wherein the drive mechanism has a drive wheel carrying the finger, this finger being fixed to a spring by means of a first pin about which it can pivot, the pivot angle of said finger being limited by a second pin to which it is fixed and which is engaged in a hole made in the drive wheel, the spring holding the finger in a position in which it is engaged in a toothing of a driven wheel of the display device in order to drive this wheel in a clockwise or anti-clockwise direction, this spring allowing said finger to free itself from the toothing of the driven wheel when the display device is being corrected by the second correction element.

2. The watch according to claim 1, wherein, when the display device is corrected by means of the second correction element, the finger, pushed by a tooth of the toothing of the driven wheel, pivots about the first pin, distances the spring from its at-rest position via the second pin which is resting against said spring and which moves into the hole, said finger returning to its initial position under the effect of the resilient return force of the spring as soon as the tooth of the toothing of the driven wheel with which it was engaged has gone past it.

3. The watch according to claim 2, wherein the drive mechanism drives the display device in a trailing manner and wherein the second correction element allows said display device to be corrected manually by increasing it in successive steps of one unit.

4. The watch according to claim 3, wherein the second correction element has a pushbutton which acts against the resilient return force of a spring held under tension between a first lug fixed to the watch case and a second lug carried by a control lever upon which the pushbutton acts, this control lever being capable of pivoting about the first lug and carrying a corrector element which penetrates into the toothing of the driven wheel.

5. The watch according to claim 4,
wherein the spring is friction fitted on the drive wheel, and
wherein the drive wheel has an opening engagable with a tool, thereby allowing the tool to rotate said spring in relation to the drive wheel.

6. The watch according to claim 3,
wherein the spring is friction fitted on the drive wheel, and
wherein the drive wheel has an opening engagable with a tool, thereby allowing the tool to rotate said spring in relation to the drive wheel.

7. The watch according to claim 2,
wherein the spring is friction fitted on the drive wheel, and
wherein the drive wheel has an opening engagable with a tool, thereby allowing the tool to rotate said spring in relation to the drive wheel.

8. The watch according to claim 1, wherein the drive mechanism drives the display device in a trailing manner and wherein the second correction element allows said display device to be corrected manually by increasing it in successive steps of one unit.

9. The watch according to claim 3, wherein the second correction element has a pushbutton which acts against the resilient return force of a spring held under tension between a first lug fixed to the watch case and a second lug carried by a control lever upon which the pushbutton acts, this control lever being capable of pivoting about the first lug and carrying a corrector element which penetrates into the toothing of the driven wheel.

10. The watch according to claims 9,
wherein the spring is friction fitted on the drive wheel, and
wherein the drive wheel has an opening engagable with a tool, thereby allowing the tool to rotate said spring in relation to the drive wheel.

11. The watch according to claim 8, wherein the spring is friction fitted on the drive wheel, and wherein the drive wheel has an opening engagable with a tool, thereby allowing the tool to rotate said spring in relation to the drive wheel.

12. The watch according to claim 1, wherein the spring is mounted rigidly on the drive wheel.

13. The watch according to claim 12, wherein the spring is friction fitted on the drive wheel, and wherein the drive wheel has an opening engagable with a tool, thereby allowing the tool to rotate said spring in relation to the drive wheel.

14. The watch according to claim 1, wherein the spring is friction fitted on the drive wheel, and wherein the drive wheel has an opening engagable with a tool, thereby allowing the tool to rotate said spring in relation to the drive wheel.

* * * * *